US012790840B2

(12) United States Patent
Smith

(10) Patent No.: US 12,790,840 B2
(45) Date of Patent: Nov. 10, 2026

(54) WALKBOARD AND END CAP

(71) Applicant: Grady F. Smith & Co., Inc., Greenville, NC (US)

(72) Inventor: Grady F. Smith, Greenville, NC (US)

(73) Assignee: GRADY F. SMITH & CO., INC., Greenville, NC (US)

( * ) Notice: Subject to any disclaimer, the term of this patent is extended or adjusted under 35 U.S.C. 154(b) by 321 days.

(21) Appl. No.: 18/591,839

(22) Filed: Feb. 29, 2024

(65) Prior Publication Data

US 2025/0277379 A1 Sep. 4, 2025

(51) Int. Cl.
*E04G 5/08* (2006.01)
*E04G 7/34* (2006.01)

(52) U.S. Cl.
CPC *E04G 5/08* (2013.01); *E04G 7/34* (2013.01)

(58) Field of Classification Search
CPC ..... E04G 5/08; E04G 7/34; E04G 5/048
See application file for complete search history.

(56) References Cited

U.S. PATENT DOCUMENTS

2007/0289813 A1* 12/2007 Bothwell ..... E04G 1/152 182/222

* cited by examiner

*Primary Examiner* — Daniel J Troy
(74) *Attorney, Agent, or Firm* — COATS & BENNETT, PLLC

(57) ABSTRACT

A walkboard for a scaffold comprises one or more planks forming a platform for standing and one or more end caps pressed into each end of the platform. The end caps include integral hooks for engagement with horizontal members of the scaffold. The planks and end caps are specially designed to enable compact stacking for storage and shipment.

20 Claims, 8 Drawing Sheets

WALKBOARD AND END CAP

TECHNICAL FIELD

The present disclosure relates generally to the field of scaffolding and, more particularly, to the design and construction of walkboards for use with scaffolding.

BACKGROUND

Scaffolds are used in the construction industry to provide an elevated work surface for a task such as painting, installing trim, drywall finishing, etc. A typical scaffold comprises two spaced-apart frames interconnected by cross-braces to form a self-supporting structure. Walkboards extend between the frames to provide an elevated surface on which a worker stands. The walkboards typically include hooks at each end that engage with horizontal frame members on the frames.

One common type of walkboard comprises two interlocking planks connected edge-to-edge to form a platform for standing. The planks are made of aluminum using an extrusion process. Each plank includes a top wall and a plurality of longitudinally extending ribs projecting down form the top wall. Hooks are bolted to each end of the platform for engagement with the frame of the scaffold to support the platform in an elevated position. For mounting the hooks, a flat cross-bar is attached to the underside of the platform. The bolts securing the hooks pass through aligned openings in the top wall of the planks and the cross bar. The head of the bolt extends above the top plane of the walkboard and the end of the bolt to which the nut is threaded extends below the bottom plane of the walkboard. This assembly method greatly increases the overall height of the final assembly and complicates stacking of the walkboards for storage and shipment.

SUMMARY

The present disclosure relates to an end cap for walkboard and method of attachment that greatly reduces the overall height of the assembled walkboard. The height reduction enables more compact packaging of the walkboard for storage and shipment, which in turn, reduces the overall cost of the walkboard to the end user.

In an exemplary embodiment, the walkboard comprises one or more planks made of aluminum using an extrusion process. In embodiments having two or more planks, the planks include interlocking features to enable the planks to be connected edge-to-edge to form a platform for standing. The platform includes a top wall with an upper surface and a plurality of longitudinally extending ribs extending downward from the bottom of the top wall. The ribs define a series of longitudinally extending channels between adjacent pairs of ribs that are open at the opposing ends of the platform.

An end cap is configured for attachment to the opposing ends of the platform. Each end cap includes a face plate configured to cover two or more of the open-ended channels in the one or more planks, a set of two or more plug bodies extending from a back surface of the face plate, and one or more hooks extending from a front surface of the face plate and configured to engage a horizontal frame member of the scaffold. The plug bodies are separated by a gap and configured to fit into adjacent channels in the platform. The gap between the plug bodies receives the rib separating the adjacent channels when the end cap is pressed onto the end of the platform.

In some embodiments, a first plug body includes an access bay extending inward from a bottom surface of the plug body. The access bay includes a first angled surface with a first mounting hole formed therein. The second plug body may include a second angled surface with a second mounting hole axially aligned with the first mounting hole. In this embodiment, a threaded bolt or other elongate fastener extends through the aligned mounting holes, passing through the rib separating the adjacent channels. A nut threads onto the end of the bolt to secure the end cap to the platform.

In some embodiments, the end cap includes at least two hooks extending from the front surface of the face plate. The hooks are spaced along the face plate such that the hooks on a first walkboard in an non-inverted orientation are offset from the hooks on a second wallboard when the second walkboard is inverted for stacking on the first walkboard. This arrangement of the hooks enables the walkboards to be vertically stacked without the need to stagger the walkboards.

In some embodiments, the end cap includes a notch along a lower edge of the face plate. A safety latch attaches to the bottom surface of the second plug body and extends through the notch in the face plate to prevent the walkboard from lifting off the horizontal member of the scaffold when the walkboard assembly is in use.

DETAILED DESCRIPTION

Figure 1:
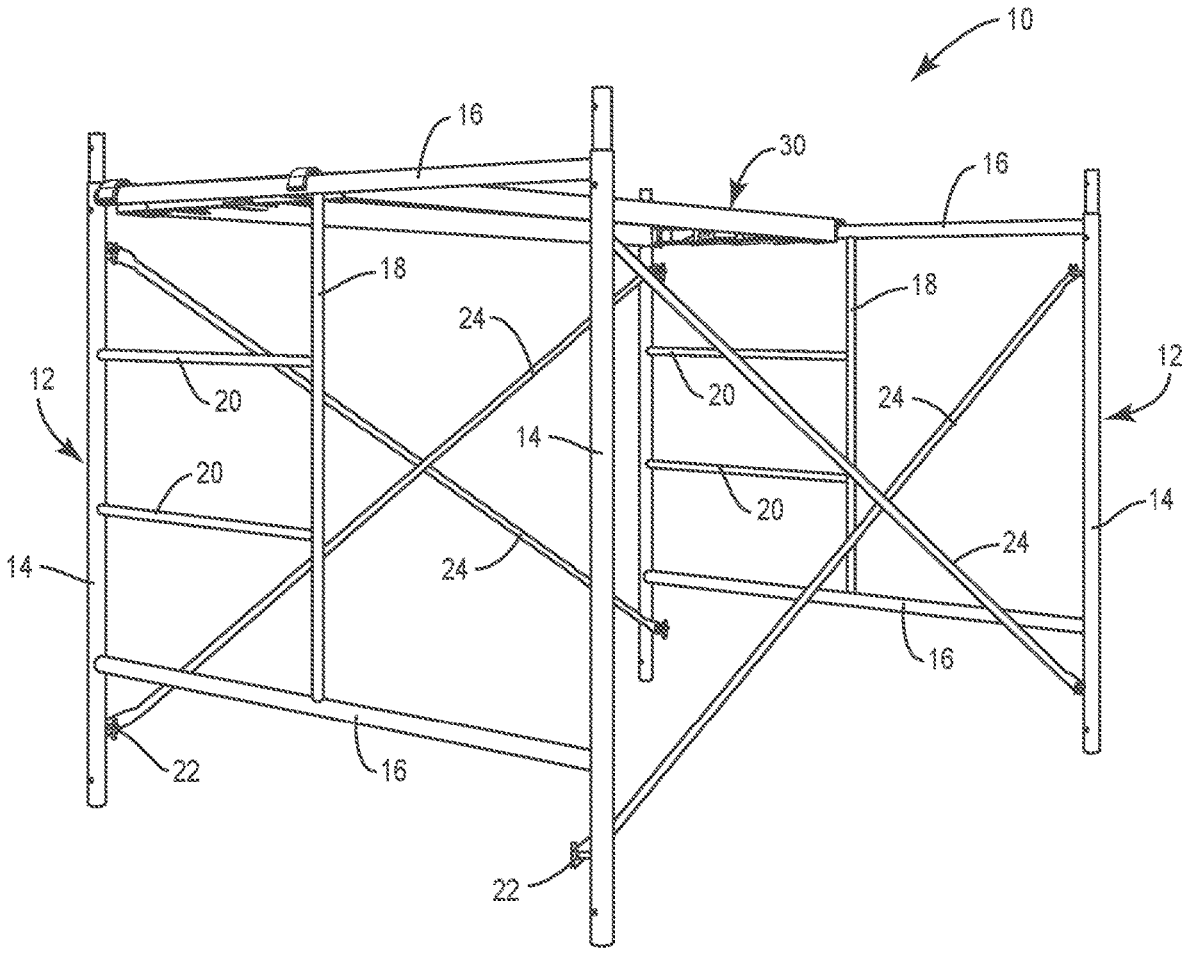
FIG. 1 is a perspective view of a scaffold and walkboard.

Referring now to the drawings, FIG. 1 illustrates an exemplary scaffold 10 and walkboard 30. The scaffold 10 comprises two spaced-apart frames 12 interconnected by cross-braces 24 to form a self-supporting structure. Each frame 12 includes two vertical posts 14 interconnected by horizontal members 16. A connecting member 18 extends vertically between the horizontal members 16 approximately midway between the vertical posts 14. Ladder rungs 20 extend between the connecting member 18 and one of the vertical posts 14 to form a ladder.

The components of the frame 12 are made of metal tubing which is welded together to form a single piece. The vertical posts 14 include stud posts 22 with latches for engagement by the cross-braces 24 as well-known in the field of scaffolding. The latches retain the cross-braces 24 on the stud posts 22 when the cross braces 24 are engaged with the stud posts 22.

One or more walkboards 30 extend between the frames 12 of the scaffold 10 to provide an elevated platform on which a worker stands. The walkboards 30 include hooks 64 at each end that engage with the horizontal members 16 on the frames 12 to support the walkboards in an elevated position. During use, a safety latch 90 (FIG. 11) can be installed to prevent the walkboards 30 from inadvertently lifting up off of the horizontal members 16 and becoming a tipping hazard.

Figure 2:
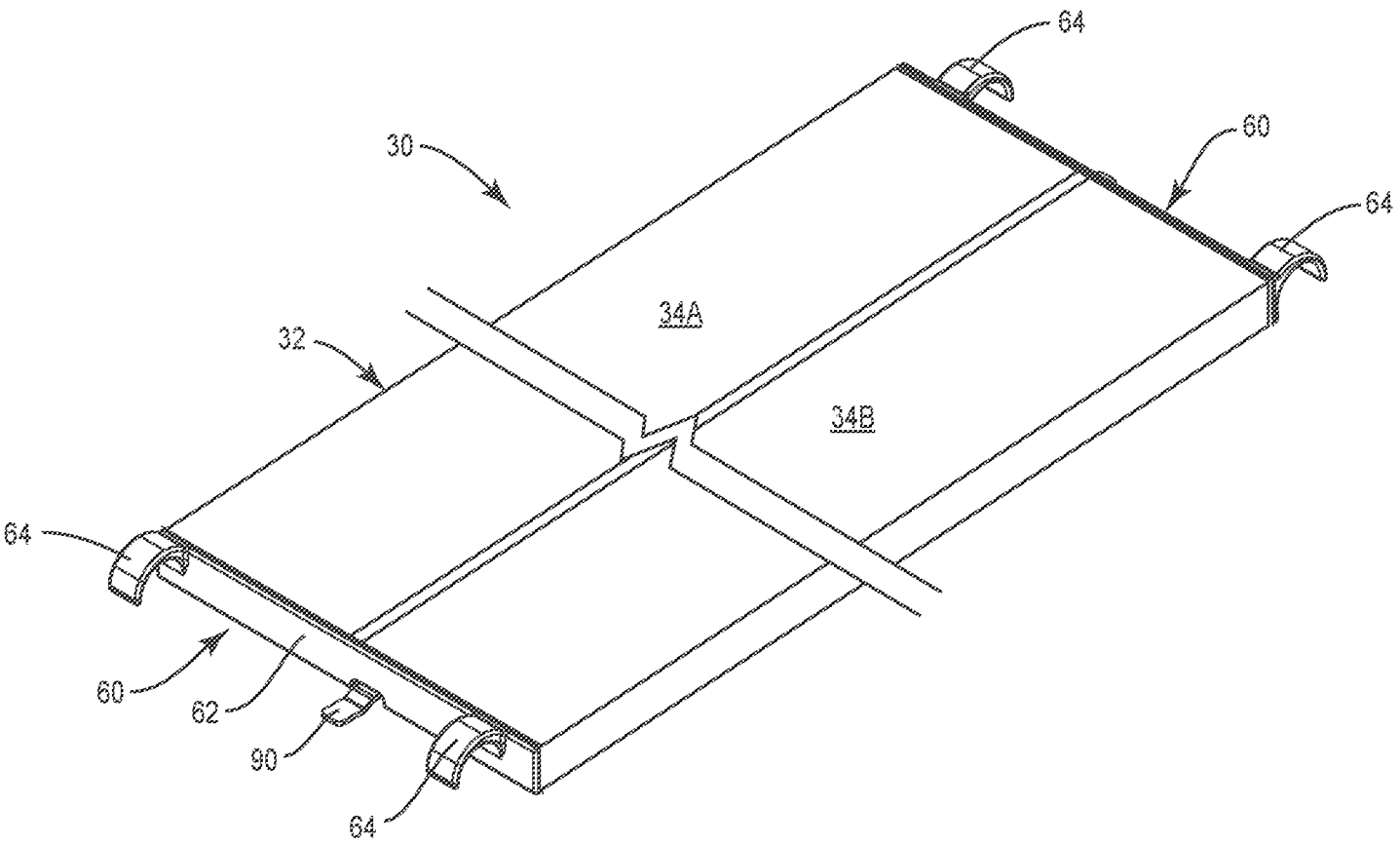
FIG. 2 is a perspective view of a walkboard.

FIG. 2 illustrates an exemplary walkboard 30 in more detail. The walkboard 30 generally comprises one or more planks 34 connected edge-to-edge to form a platform 32, and a pair of end caps 60 pressed onto opposing ends of the platform 32. The end caps 60 include integrally formed hooks 64 that engage with the horizontal members 16 of the frames 12 as previously described.

Figure 3A:
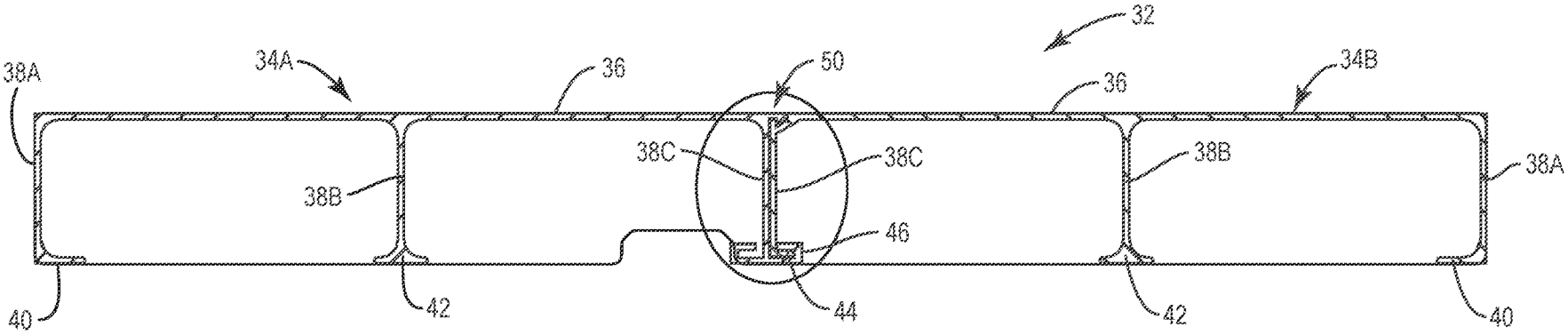
FIG. 3A is a cross-section of the walkboard with the end cap removed.
Figure 3B:
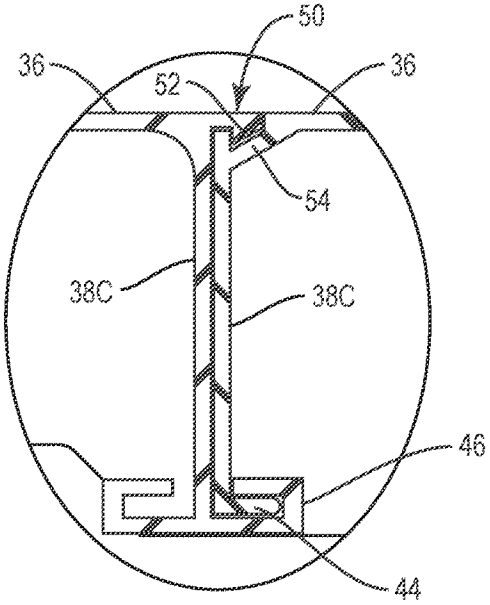
FIG. 3B is a close-up cross-section of the walkboard with the end cap removed.

FIGS. 3A and 3B illustrate one embodiment of a platform 32 comprising two interconnected planks 34, which can be formed via extrusion of a lightweight material, such as aluminum. For purposes of the following discussion, reference number 34 is used to refer to the planks generally, while reference numbers 34A and 34B are used to differentiate between the planks 34 when necessary.

Each plank 34 includes a top wall 36 having an upper surface and a bottom surface and a plurality of longitudinally-extending ribs 38 projecting down from the top wall 36. The ribs 38 extend longitudinally along the length of the plank 34, i.e., parallel to the longitudinal axis of the plank 34. In the illustrated embodiment, each plank 34 includes three ribs 38: an outer rib 38A, an interior rib 38B, and an inner rib 38C. The outer rib 38A of each plank 34 forms an outer wall of the platform 32 and has a generally L-shaped cross section with a flange 40 extending inward from the lower end of the outer rib 38A. The interior rib 38B of each plank 34 has a T-shaped cross-section with a flange 42 at the lower end of the rib 38B that extends outward from each side of the interior rib 38B. The inner ribs 38 form the inner walls of the planks 34 that abut when the planks 34 are assembled edge-to-edge.

The planks 34A and 34B are designed with interlocking features that enable the planks 34A and 34B to slide together longitudinally during assembly. These interlocking features are shown more clearly in FIG. 3B The interlocking features provides two points of engagement: one at the lower end of the inner ribs 38C and one adjacent the top surface 36. The complementary features enable the planks 34A and 34B to be assembled by relative sliding motion after aligning the interlocking features on the two planks 34A, 34B.

A first set of interlocking features comprises a flange 44 that extends outwardly away from the lower end of the inner rib 38C on one plank 34 (plank 34B in this example) and a complementary channel 46 formed at the lower end of inner rib 38C of the other plank 34 (plank 34A in this example). The flange 46 is designed to slide longitudinally within the channel 46 when the planks 34A and 34B are being assembled while restricting relative vertical and relative side-to-side motion.

A second set of interlocking features comprises a tongue and groove connection 50 formed in the top surface 36 of the planks 34. The tongue and groove connection 50 includes a tongue 52 on one plank 34 (plank 34A in this example) that projects out horizontally beyond the inner rib 38C and a complementary groove 54 formed in the other plank 34 (plank 34B in this example) to receive the projecting tongue 52 of plank 34A. The tongue and groove connection 50 is designed so that the tongue 52 slides longitudinally within the groove 54 when the planks 34A and 34B are being assembled while restricting relative side-to-side motion. The tongue 52 includes a channel behind the head of the tongue 52. This channel receives the upper end of inner rib 38C on plank 34B.

To assemble the platform 32, the planks 34A and 34B are placed end-to-end and offset so that interlocking features of the planks 34 align. The planks 34 will then slide together longitudinally. Afterwards, the end caps 60 are installed, which prevent relative longitudinal movement of the planks 34. Any number of planks 34 can be assembled together to form a platform of any desired width. The illustrated embodiment includes two planks 34, but other embodiment could include 3 or more planks 34.

Figure 4:
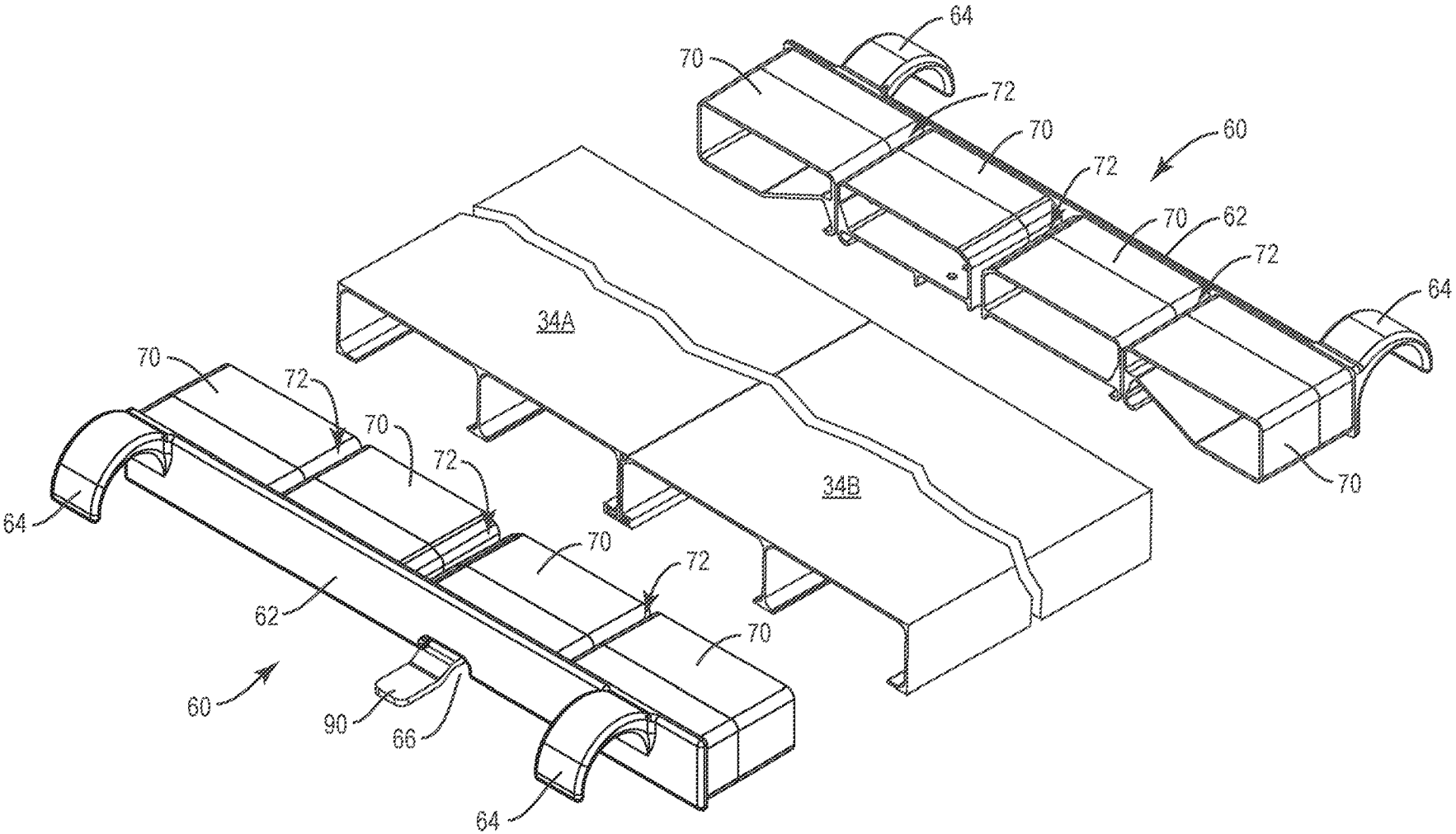
FIG. 4 is an exploded perspective view of a walkboard.
Figure 8:
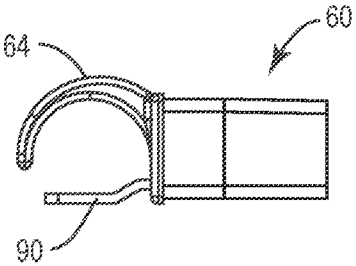
FIG. 8 is a side view of an end cap for the walkboard.
Figure 5:
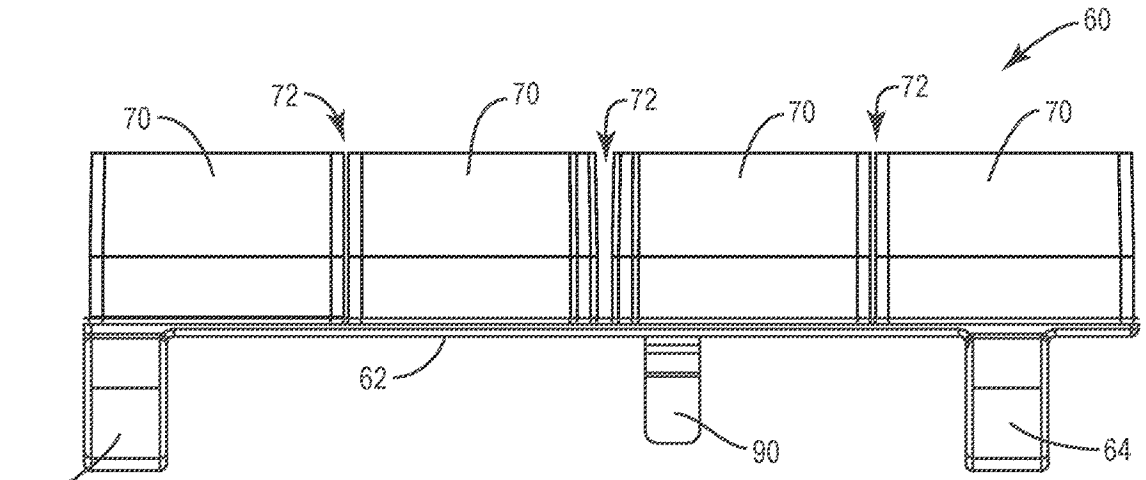
FIG. 5 is a top view of an end cap for the walkboard.
Figure 6:
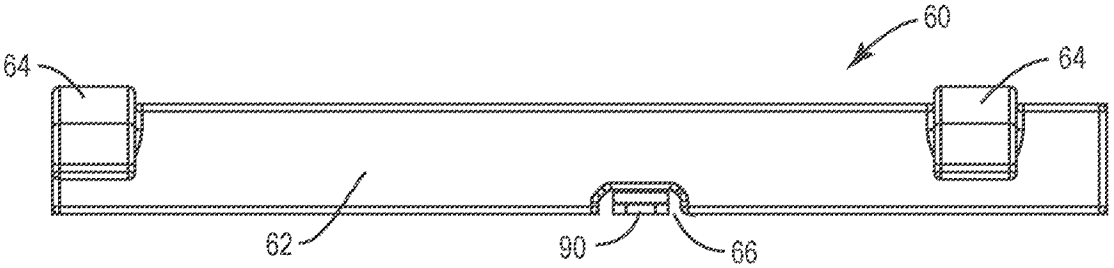
FIG. 6 is a front view of an end cap for the walkboard.
Figure 7:
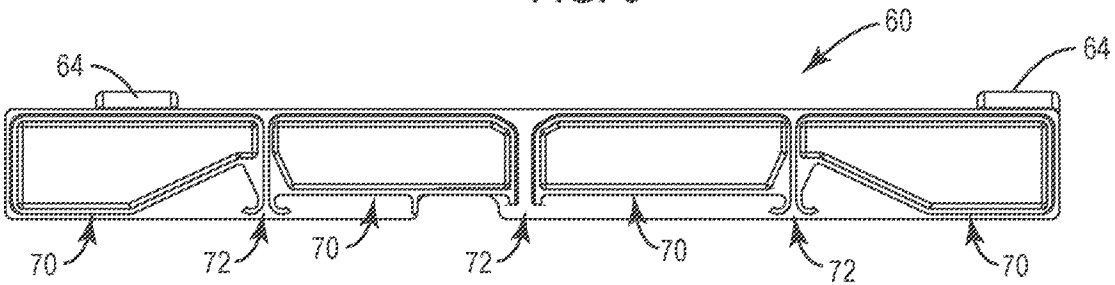
FIG. 7 is a rear view of an end cap for the walkboard.
Figure 9:
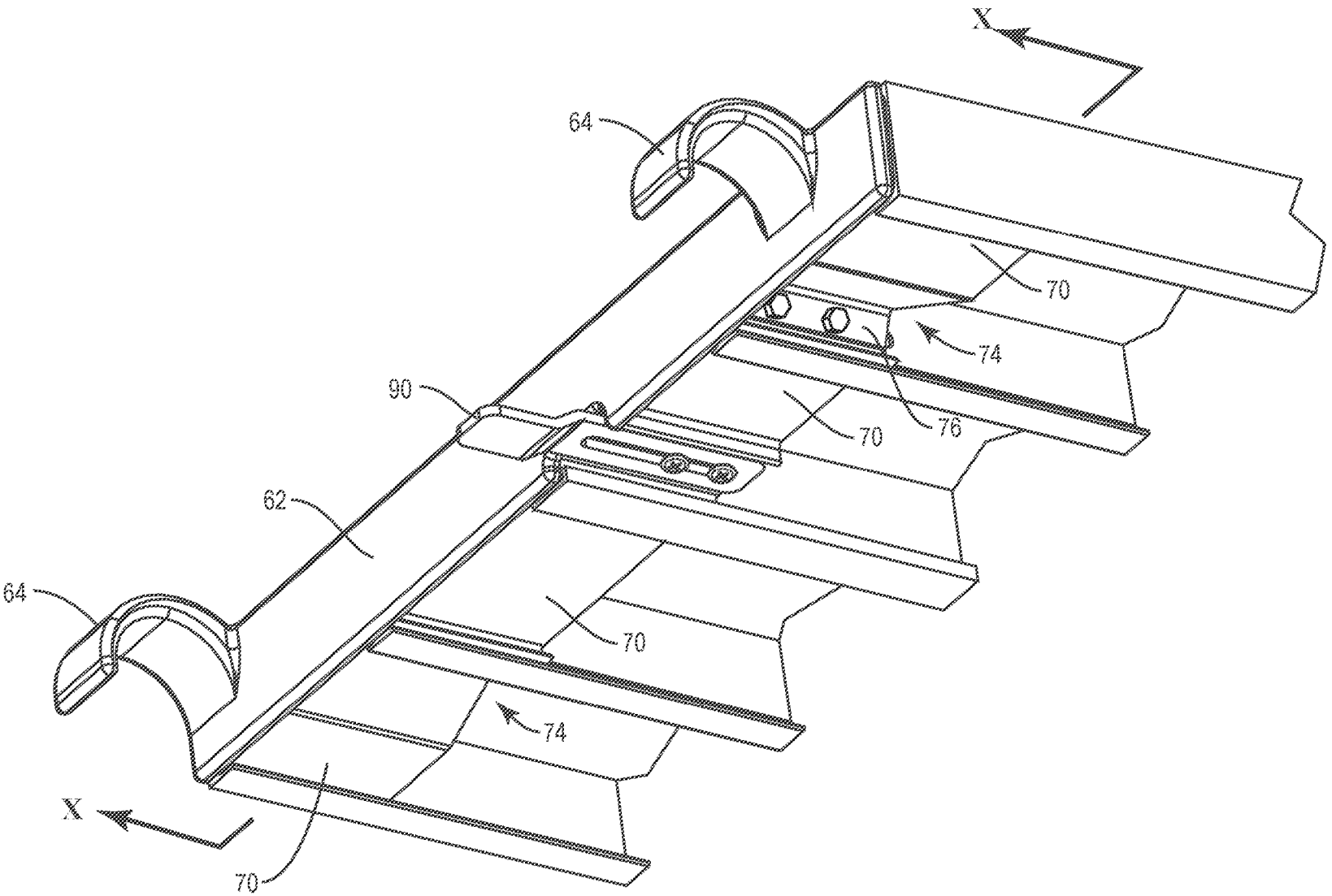
FIG. 9 is a partial perspective view showing one end of the walkboard from below.
Figure 10A:
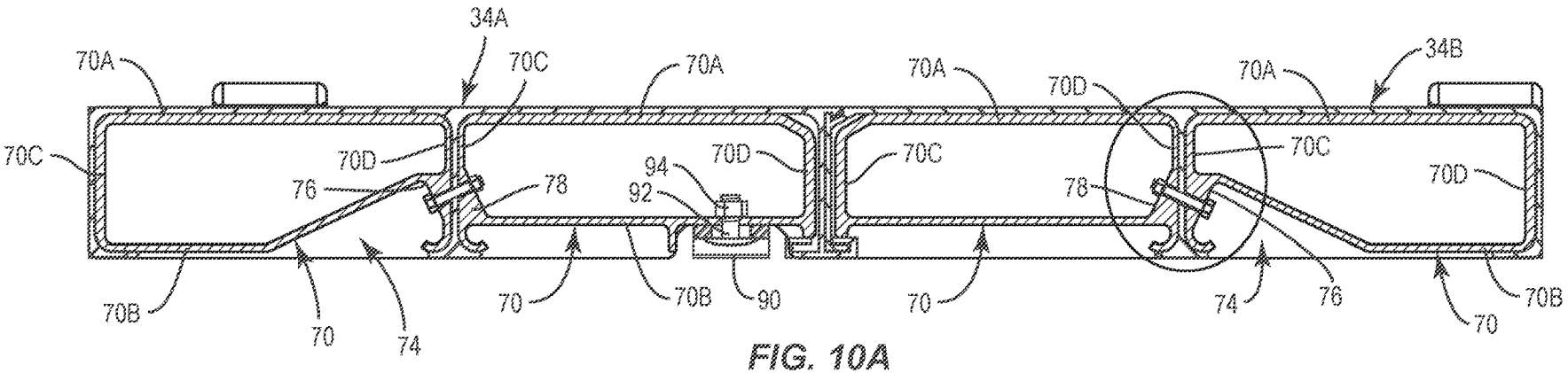
FIG. 10A is a cross-section of the walkboard with the end cap installed.
Figure 10B:
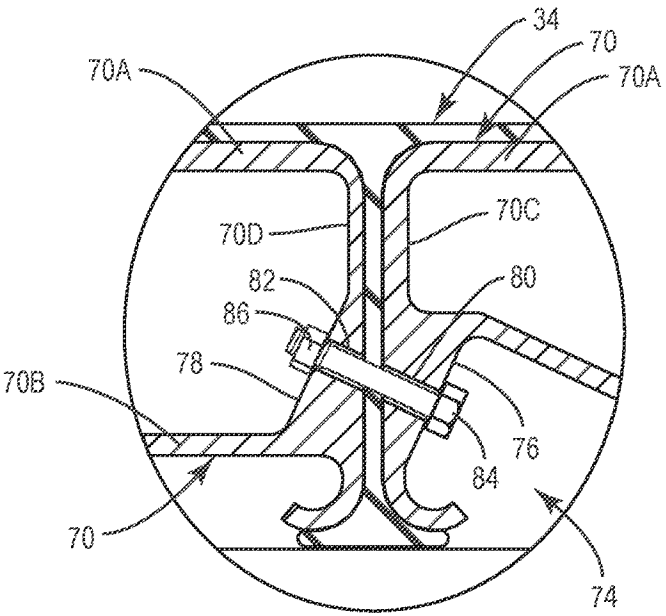
FIG. 10B is a close-up cross-section of the walkboard with the end cap installed.

FIGS. 4-8 illustrate the end cap 60. The end cap 60 comprises a face plate 62, one or more hooks 64 extending from a front surface of the face plate 62, and a plurality of plug bodies 70 extending from the back of the face plate 62. The end cap 60 is designed to press onto the end of the platform 32 after the planks 34 are connected. As shown in FIG. 4, the plug bodies 70 are separated by gaps 72 and designed to fit into the open-ended channels in the platform 32. The gaps 72 between the plug bodies 70 provide space for the ribs to slide into when the end cap 60 is pressed onto the end of the platform 32.

FIGS. 4-8 illustrate one embodiment of an end cap 60 that extends the entire width of the walkboard 30 so only one end cap 60 needs to be installed at each end of the walkboard 30. In this embodiment, the face plate 62 extends the full width to the platform 32 and covers all four of the open-end channels in the platform 32. This embodiment includes two hooks 64 extending from the front of the face plate 62 and four plug bodies 70 extending from the back of the face plate 62.

In other embodiments, two or more end caps 60 could be installed at each end of the walkboard 30. As an example, one embodiment of the walkboard 30 could include two end caps 60 at each end of the walkboard 30 (four in total), with each end cap including one hook 64 and two plug bodies 70. One of the end caps 60 could be designed to press onto plank 34A and the other end cap 60 could be designed to press onto plank 34B.

Returning to FIGS. 4-8, the unitary end cap 60 includes two hooks 64. One hook 64 is disposed adjacent one side edge of the walkboard 30. The other hook 64 is offset from the opposing side edge. This offset enables the assembled walkboards 30 to be stacked more compactly by inverting one of the walkboards 30. In a mini-stack of two walkboards 30, the first walkboard 30 is placed in an upright position. It will be noted that the curvature of the hooks 64 extend above the plane of the top plane of the walkboard 30, which is defined by the top surface of platform 32. The second walkboard 30 is inverted and stacked on the first walkboard 30. Because of the offset, the hooks 64 do not interfere when the walkboards 30 are stacked. A larger stack can then be made by stacking the mini-stacks on top of each other up to any desired height.

The plug bodies 70 are also designed so that the plug bodies 70 will not extend below the bottom plane of the walkboard 30, which is defined by the lower end of the outer ribs 38A. Each of the plug bodies 70 has a generally rectangular configuration with a top wall, 70A, bottom wall 70B, and side wall 70C and 70D. The overall outer shape provides a friction fit with the matching channels in the platform 32. The plug bodies are hollow and open towards the back so that the interior of the plug bodies 70 is accessible from the back.

Conceptually, there are two pairs of plug bodies. Each pair comprises an outer plug body 70 adjacent one side edge of the platform 32 and the adjacent inner plug body 70. The two outer plug bodies 70 adjacent the opposing sides of the walkboard 30 have an access bay 74 formed in the bottom wall 70B with an angled surface 76 that is part of the side wall 70D. The two inner plug bodies 70 include an angled interior surface 78 that is part of the side wall 70C. For each pair of plug bodies 70, axially aligned openings 80 and 82 are formed respectively in the angled surfaces 76 and 78 for a bolt that secures the end cap 60 to the platform 32. During installation, a hole is drilled through the intervening rib 38 between the outer and inner plug body 70 in each pair to allow installation of the bolt 84. A nut 86 is threaded onto the end of the end of each bolt 84 and tightened to secure the end cap 60 to the platform 32. The installation of the end cap 60 prevents relative longitudinal movement of the planks 34.

Figure 11:
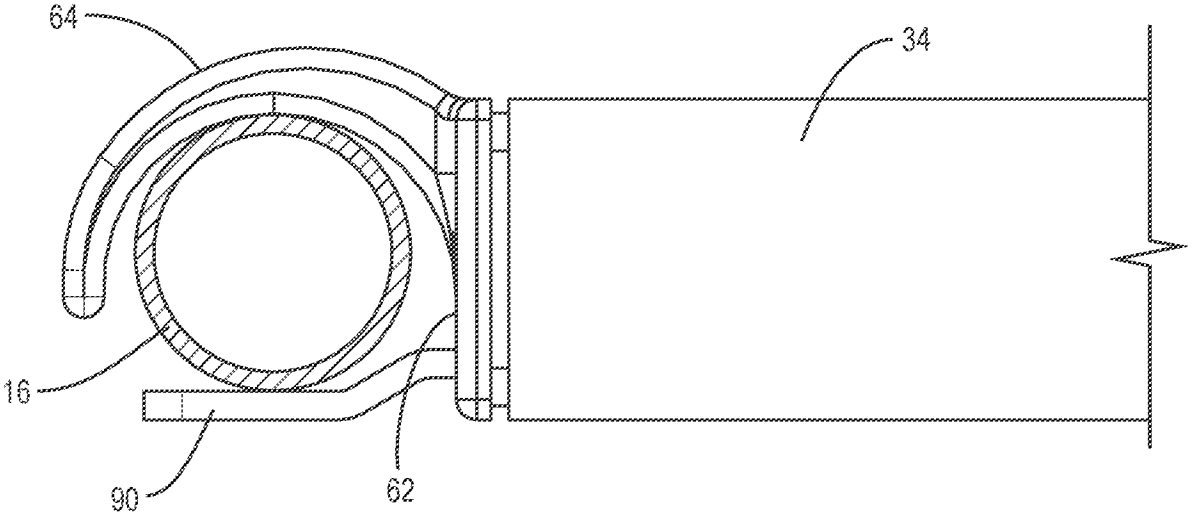
FIG. 11 is a side view showing one end of the walkboard.

In order to prevent the walkboard 30 from lifting off the horizontal member 16 of the scaffold 10, a safety latch 90 is attached to one of the plug bodies after the walkboard is set into place on the scaffold 10. As shown in FIG. 11, the safety latch 90 extends below the horizontal member 16 of the scaffold 10 preventing the walkboard 30 from lifting up. The safety latch 90 is secured to one of the inner plug bodies 70 by a bolt 92 and nut 94. When secured in place, the safety latch 90 extends through a notch 66 in the face plate 62 so that the safety latch 90 stays above the bottom plane of the walkboard 30 and does not interfere with compact stacking.

In use, a platform 32 is assembled from two planks 34 and two end caps 60. The planks 34 are placed end-to-end and offset so that interlocking features of the planks 34 align. The planks 34 will then slide together longitudinally. Afterwards, the end caps 60 are pressed into each end of the platform 32 and secured by bolts 84 and nuts 86 as previously described. During installation, a hole needs to be drilled through the ribs 38 separating the outer plug bodies 70 from the adjacent inner plug bodies 70. Once assembled, the walkboard 30 can be placed on the scaffold 10 with the hooks 64 at each end engaged with a horizontal member 16 of the scaffold 10. Finally, to prevent the walkboard 30 from lifting up off the horizontal member 16, the safety latch 90 is installed at each end of the walkboard 30 to hold the walkboard 30 in place.

What is claimed is:

1. A walkboard for use with a scaffold, the walkboard comprising:

one or more planks forming a platform for standing, wherein the platform includes a top wall and a plurality of longitudinally extending ribs projecting downward from the top wall, and wherein the ribs define a series of longitudinally extending channels between adjacent pairs of ribs that are open at the opposing ends of the platform;

an end cap configured for attachment to each end of the platform, each end cap comprising:

a face plate having a front surface and a back surface and configured to cover two or more of the open-ended channels in the platform forming the platform;

a first plug body having a top surface, a bottom surface, and two sidewalls extending from the back surface of the face plate and configured to fit into a first channel in the platform, the first plug body including an access bay extending inward from the bottom surface and having a first angled surface with a first mounting hole formed therein;

a second plug body having a top surface, a bottom surface, and two sidewalls extending from the back surface of the face plate and configured to fit into a second channel in the platform adjacent to the first channel;

a gap between the first and second plug bodies configured to receive the rib between the adjacent channels when the end cap is pressed onto the end of the platform;

at least one hook extending from the front surface of the face plate and configured to engage a horizontal member of the scaffold;

an elongate fastener for securing the end cap to the platform, the elongate fastener configured to extend through the first mounting hole in the first plug body and at least partially into a first rib of the plurality of ribs separating the first and second channels.

2. The walkboard of claim 1, wherein the second plug body includes a second angled surface with a second mounting hole, the second angled surface being disposed generally parallel to the first angled surface in the first plug body with the second mounting hole axially aligned with the first mounting hole.

3. The walkboard of claim 2, wherein the elongate fastener comprises a bolt configured to extend through the first and second mounting holes and a nut configured to thread onto one end of the bolt to fasten the end cap to the first rib separating the first and second channels.

4. The walkboard of claim 1, wherein the end cap includes at least two hooks extending from the front surface of the face plate.

5. The walkboard of claim 1, further comprising:

a notch in a lower edge of the face plate;

a safety latch configured to attach to the bottom surface of the second plug body and to extend through the notch in the face plate to prevent the walkboard from lifting off the horizontal member of the scaffold when the walkboard assembly is in use.

6. The walkboard of claim 5, wherein the safety latch does not extend below a bottom plane of the walkboard.

7. The walkboard of claim 1:

wherein the one or more planks comprises two planks;

wherein the face plate is configured to extend laterally across all planks of the platform.

8. A first walkboard for use with a scaffold, the first walkboard comprising:

one or more planks forming a platform for standing, wherein the platform includes a top wall and a plurality of longitudinally extending ribs projecting downward from the top wall, and wherein the ribs define a series of longitudinally extending channels between adjacent pairs of ribs that are open at the opposing ends of the platform;

an end cap assembly configured for attachment to each end of the platform, each end cap assembly comprising:

one or more face plates covering the open-ended channels in the platform; and a pair of hooks extending from the one or more face plates and configured to engage a horizontal member of the scaffold, wherein the hooks are arranged on the one or more face plates such that the hooks on the first walkboard in a non-inverted orientation are offset from hooks on a second walkboard that is substantially similar to the first walkboard when the second walkboard is inverted for stacking on the first walkboard;

a plurality of plug bodies extending from a back of the one or more face plates and configured to fit into respective channels in the platform; wherein the plurality of plug bodies comprises:

a first plug body configured to fit into a first channel in the platform, the first plug body having a first angled surface with a first mounting hole formed therein;

a second plug body configured to fit into a second channel in the platform adjacent to the first channel, the second plug body having a second angled surface with a second mounting hole formed axially aligned with the first mounting hole; and an elongate fastener configured to extend through the aligned mounting holes to secure the corresponding end cap assembly to the platform.

9. The first walkboard of claim 8, wherein the elongate fastener comprises a bolt configured to extend through the first and second mounting holes and a nut configured to thread onto one end of the bolt to fasten the end cap assembly to the first rib separating the first and second channels.

10. The first walkboard of claim 8, further comprising:

a notch in a lower edge of the face plate;

a safety latch configured to attach to the bottom surface of the second plug body and to extend through the notch in the face plate to prevent the walkboard from lifting off the horizontal member of the scaffold when the walkboard assembly is in use.

11. The first walkboard of claim 10, wherein the safety latch does not extend below a bottom plane of the walkboard.

12. The first walkboard of claim 8, wherein the pair of hooks both protrude above a top plane of the platform defined by an uppermost top wall of the one or more planks.

13. The first walkboard of claim 8, wherein the first plug body and second plug body are integrally formed with a first face plate of the one or more face plates.

14. The first walkboard of claim 13, wherein the first face plate extends laterally across a full width of the platform.

15. The walkboard of claim 1, wherein the at least one hook protrudes above a top plane of the platform defined by an uppermost top wall of the one or more planks.

16. A walkboard for use with a scaffold, the walkboard comprising:

one or more planks forming a platform for standing, wherein the platform includes a top wall and a plurality of longitudinally extending ribs projecting downward from the top wall, and wherein the ribs define a series of longitudinally extending channels between adjacent pairs of ribs that are open at the opposing ends of the platform;

an end cap assembly configured for attachment to each end of the platform, each end cap assembly comprising:

one or more face plates covering the open-ended channels in the platform; and a pair of hooks extending from the one or more face plates and configured to engage a horizontal member of the scaffold;

a plurality of plug bodies extending from a back of the one or more face plates and configured to fit into respective channels in the platform; wherein the plurality of plug bodies comprises:

a first plug body configured to fit into a first channel in the platform, the first plug body having a first angled surface with a first mounting hole formed therein;

a second plug body configured to fit into a second channel in the platform adjacent to the first channel, the second plug body having a second angled surface with a second mounting hole formed axially aligned with the first mounting hole;

an elongate fastener configured to extend through the aligned mounting holes to secure the corresponding end cap assembly to the platform.

17. The walkboard of claim 16, further comprising:

a notch in a lower edge of a first face plate of the one or more face plates;

a safety latch configured to attach to the bottom surface of the second plug body and to extend through the notch to prevent the walkboard from lifting off the horizontal member of the scaffold when the walkboard assembly is in use.

18. The walkboard of claim 17, wherein the safety latch does not extend below a bottom plane of the walkboard.

19. The walkboard of claim 16, wherein the pair of hooks both protrude above a top plane of the platform defined by an uppermost top wall of the one or more planks.

20. The walkboard of claim 16:

wherein the one or more planks comprises two planks;

wherein the one or more face plates comprises a first face plate that is configured to extend laterally across all planks of the platform.

* * * * *